US005568731A

United States Patent [19]

Reali

[11] Patent Number: 5,568,731

[45] Date of Patent: Oct. 29, 1996

[54] AMBIENT AIR FREEZING SYSTEM AND PROCESS THEREFOR

[75] Inventor: Michael Reali, Old Brookville, N.Y.

[73] Assignee: Crumb Rubber Technology, Inc., Jamaica, N.Y.

[21] Appl. No.: 395,431

[22] Filed: Feb. 28, 1995

[51] Int. Cl.[6] ..... F25D 9/00; F25B 9/00

[52] U.S. Cl. ..... 62/87; 62/402

[58] Field of Search ..... 62/87, 402

[56] References Cited

U.S. PATENT DOCUMENTS

| | | | |
|---|---|---|---|
| 4,207,754 | 6/1980 | Chaboseau et al. | 62/402 |
| 4,326,388 | 4/1982 | McFee | 62/402 X |
| 4,445,639 | 5/1984 | Kinsell et al. | 62/402 X |
| 5,017,682 | 4/1992 | Cosby | 62/402 X |
| 5,150,585 | 9/1992 | Markiewicz | 62/402 X |
| 5,373,707 | 12/1994 | Ostersetzer et al. | 62/402 X |
| 5,438,845 | 8/1995 | Kirschner et al. | 62/402 X |

*Primary Examiner*—Christopher Kilner
*Attorney, Agent, or Firm*—Collard & Roe, P.C.

[57] ABSTRACT

An ambient air freezing system for producing chilled air in the cryogenic range of −120° C. to −180° C. without the use of cryogenic chemicals or other refrigerants.

8 Claims, 4 Drawing Sheets

AMBIENT AIR FREEZING SYSTEM AND PROCESS THEREFOR

BACKGROUND OF THE INVENTION

1. Field of the Invention

The present invention relates to refrigeration and freezing. More particularly, it relates to an ambient air freezing system and process capable of chilling ambient air to cryogenic temperatures of −120° C. without the use of cryogenic chemicals or other refrigerants.

2. The Prior Art

Refrigeration is a process of cooling or freezing a substance to a temperature lower than that of its surroundings and maintaining that substance in a cold state. Refrigeration can be performed by conventional methods such as convection or thermal conduction. Other, more complex methods include the exploitation of thermoelectric properties of semiconductors, the magnetothermoelectric effects in semimetals, or the diffusion of $^3$He atoms across the interface between distinct phases of liquid helium having high and low concentrations of $^3$He in $^4$He.

Commercial refrigeration systems such as, for example, a vapor-compression refrigerator use refrigerants to obtain the low temperatures within the desired area. This type of refrigerator consists of a compressor, a condenser, a storage tank, a throttling valve and an evaporator. The refrigerant is a liquid which partly vaporizes and cools as is passes through the throttling valve. Among the common refrigerants are ammonia, sulfur dioxide, and various halides of methane and ethane. The most commonly used are the Freons® of which Freon-12® is dichlorodifluoromethane. In the vapor-compression system, near constant pressures are maintained on either side of the throttling valve by the compressor.

Another example of a refrigeration system of the prior art is a vapor-absorption refrigeration system. In this system, there are no moving parts. The added energy comes from a gas or liquid fuel burner or from an electrical heater, as heat, rather than from the compressor, as work. This system also uses a refrigerant while maintaining total pressure throughout the system is constant and therefore no valves are needed.

With the growing awareness of the environmental effects of using refrigerants to obtain low refrigeration temperatures, it is desirable to have a refrigeration system that utilizes nothing but ambient air and does not use refrigerants to produce refrigeration temperatures down into the cryogenic range.

SUMMARY OF THE INVENTION

The present invention provides an ambient air freezing system capable of producing chilled air at cryogenic temperature levels of −120° C.

According to the invention, the ambient air freezing system includes an ambient air inlet for receiving the ambient air. A first control means controls the flow of the incoming air to one of two regenerators while simultaneously controlling the flow of cycled air from the other of the regenerators to the compressor. A second control means controls the flow of the chilled air output of one of the regenerators while simultaneously controlling the flow of cycled air from an expander into the other of the regenerators. A cooling chamber receives the chilled air output of the system and has a return coupled to the expander for further cycling the air through the system. A control valve connected to the cooling chamber input and return, selectively controls the flow of air into the cooling chamber, and allows the system to be initially charged without the cooling chamber connected thereto.

The ambient air freezing system of the present invention can be used for all freezing applications of perishable and non-perishable products. This includes, but is not limited to, the food, flower and recycling industries.

It is therefore an object of the present invention to provide an ambient air freezing system capable of producing cryogenic air temperatures down to −120° C.

It is another object of the invention to provide an ambient air freezing system that does not require the use of cryogenic chemicals or any other refrigerants to reach cryogenic temperatures.

Yet another object of the invention is to provide an ambient air freezing system that can be used for all freezing applications of perishable and non-perishable items.

It is a further object of the invention to provide an ambient air freezing system that requires significantly less power consumption than the cryogenic freezers of the prior art.

Yet another object of the invention is to provide an ambient air freezing system that operates efficiently and reliably.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
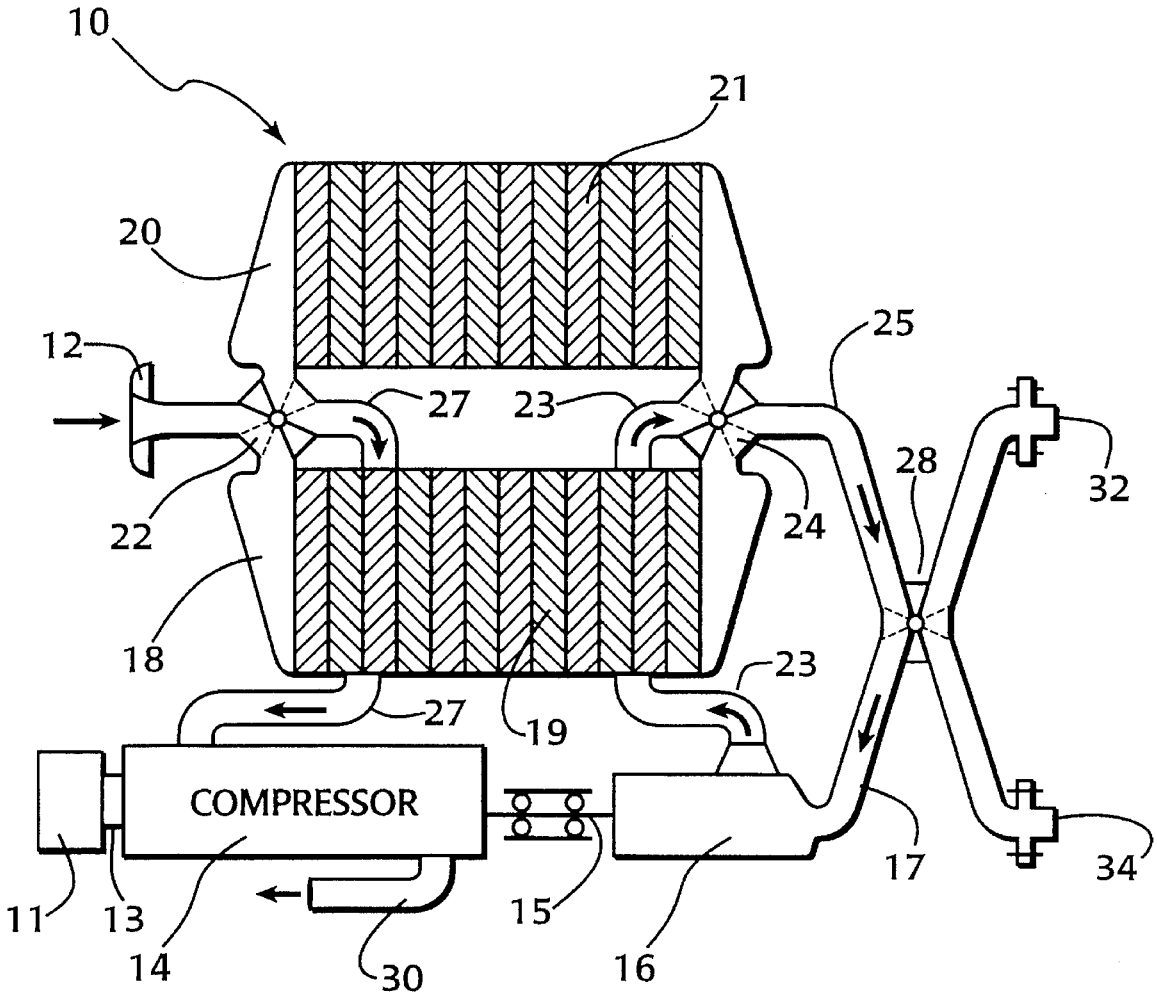
FIG. 1 is a schematic diagram of the ambient air freezing system upon initial activation according to the invention.

Turning now in detail to the drawings, FIG. 1 shows the ambient air freezing system 10 in its initial activation stage. Upon the initial activation of the system, valves 22 and are in their first initial position, as shown. By closing valve 28, and eliminating cooling chamber 26 (FIG. 3) the chilled air output 25 is directly connected with input 17 to expander 16. This enables the system to reach the desired cryogenic temperatures much faster than if the cooling chamber were connected.

The first cycle of the system will reduce the received ambient air by approximately 30° C. Subsequent cycles will further reduce the air temperature in substantially 30° increments until the losses in the system balance out and an equilibrium temperature of substantially −120° C. is reached. When the system approaches the desired −120° C. temperature, each subsequent cycle will not reduce the temperature 30 degrees. Thus, freezing system 10 is capable of reducing the ambient air to temperatures below −120° C., such as, for example, −180° C.

Figure 3:
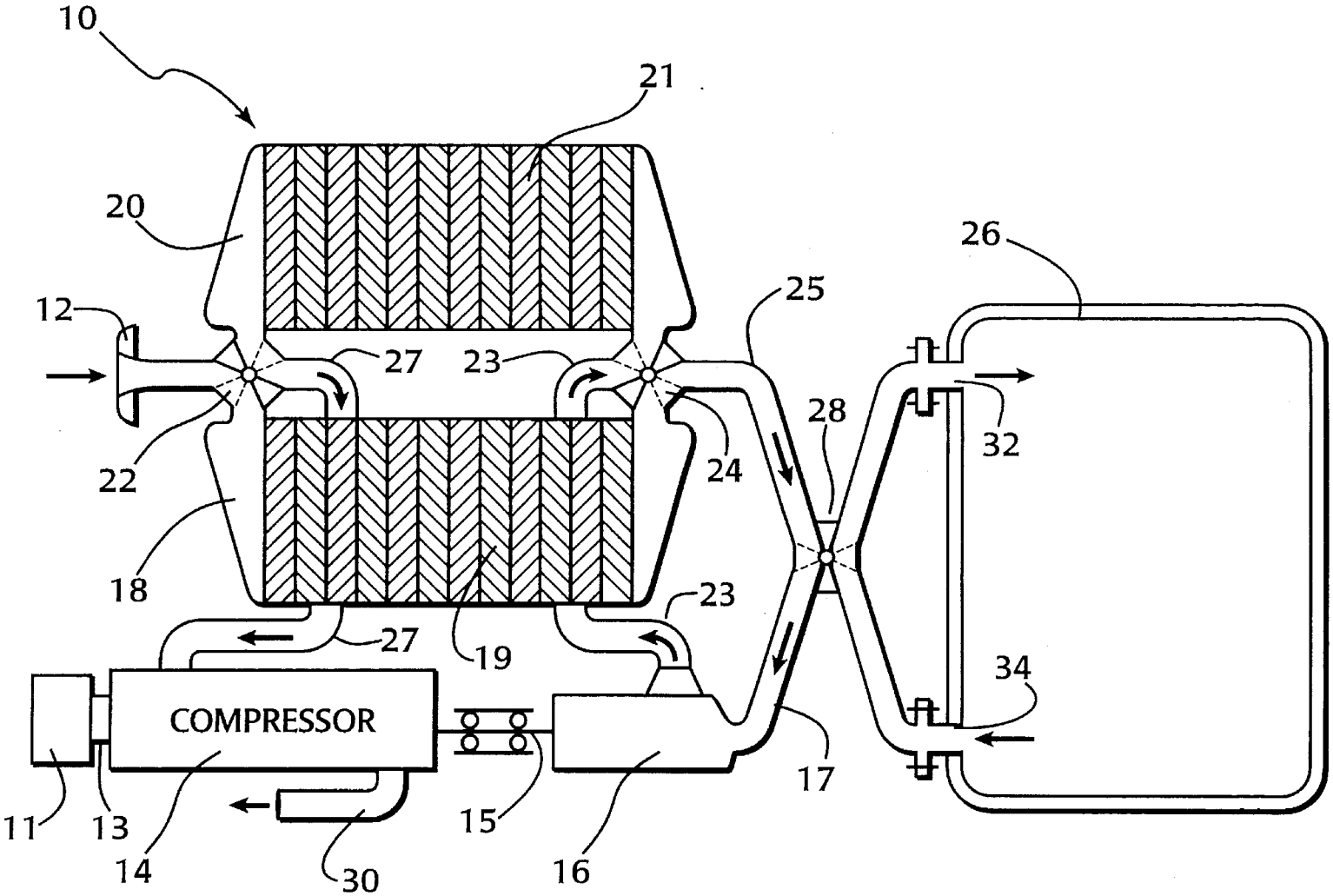
FIG. 3 is a schematic diagram of the ambient air freezing system during operation according to the invention.

The ambient air freezing system 10 consists of an electric motor 11, of any suitable known type, connected to a compressor 14 through a gearbox 13, a turbo expander 16 mounted on the same shaft 15 as compressor 14, a first regenerator 18, a second regenerator 20, a fan 12, valves 22, 24 and 28, and a cooling chamber 26 (FIG. 3).

Fan 12 blows ambient air from outside the system through the packing 19 of first regenerator 18. The air is then pumped from regenerator 18 out the chilled air output 25 and directly into expander 16. Expander 16 expands the air to 0.5 atmosphere, thereby reducing the temperature of the air approximately 30° C. The cooled air is circulated into regenerator 20 via line 23 and valve 24. The cooled air cools packing 21 of regenerator 20, and is then fed via line 27, into compressor 14 where the air is compressed back to 1 atmosphere and then exhausted from the system via exhaust outlet 30. While the cooled air passes through regenerator 20, it simultaneously cools the packing 21 and sublimates all moisture left in the regenerator from the previous cycle. Input 27 and output 23 of compressor 14 and expander 16, respectively, do not pass through regenerator 18, but pass around said regenerator.

Figure 2:
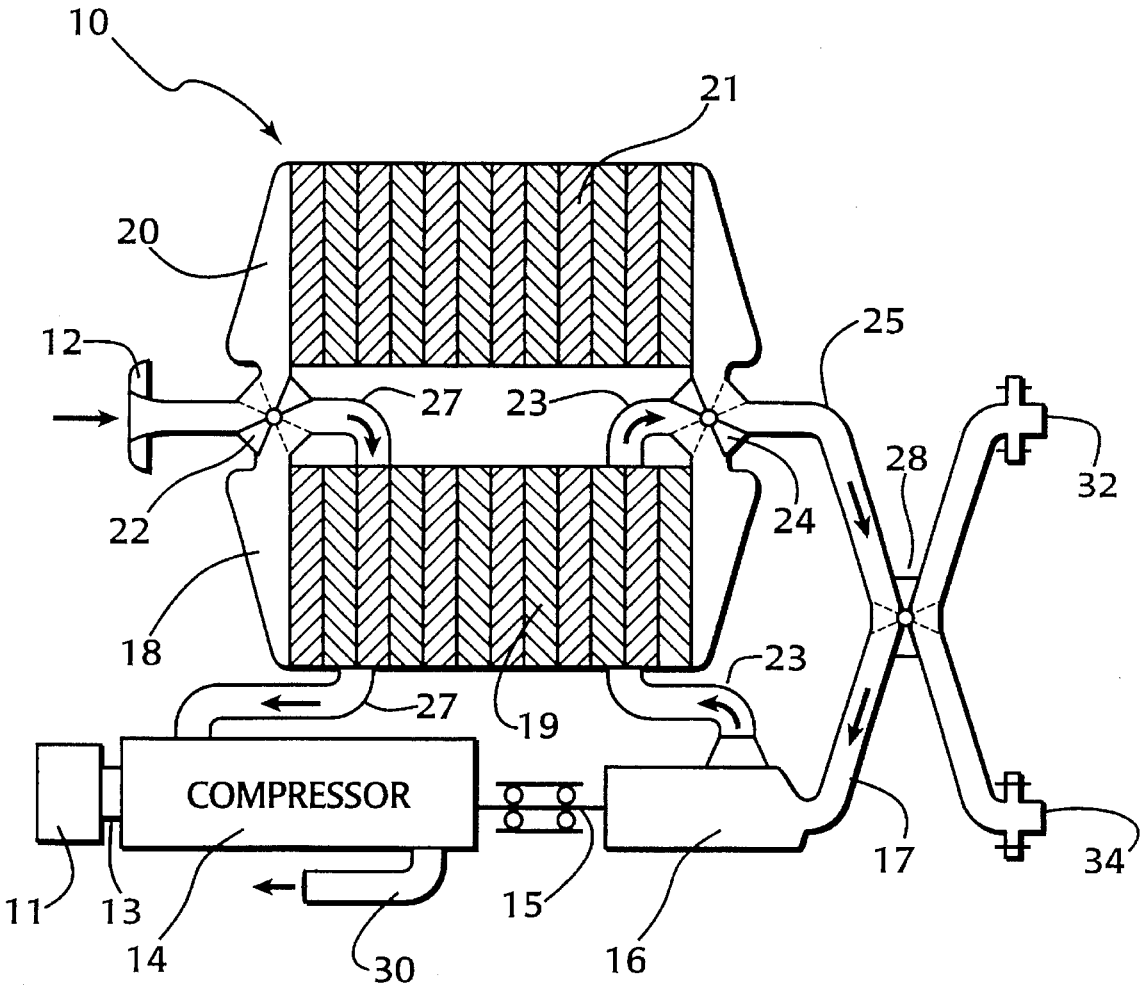
FIG. 2 is a schematic diagram of the ambient air freezing system according to the invention after initial activation thereof.

FIG. 2 shows the second cycle of the freezing system 10 after initial activation. After the initially cooled air is circulated from regenerator 20 into compressor 14, valves 22 and 24 simultaneously switch positions, as shown. Now fan 12 blows ambient air into the cooled regenerator 20 where the air is cooled. The air is then circulated from regenerator 20 through output 25, via valve 24, and into expander 16 where the air is expanded to 0.5 atmosphere. The expanded, and thereby cooled air is pumped into regenerator 18, via valve 24. The packing 19 of regenerator 18 is then cooled by the incoming air. Once the air has circulated through regenerator 18, it is fed into compressor 14, via valve 22 and line 27, where it is compressed back to 1 atmosphere and exhausted from the system. The cycle as described in FIGS. 1 and 2 must be repeated several times in order to have packings 19 and 21 of first and second regenerators 18 and 20, respectively be preliminarily cooled to −120° C.

FIG. 3 shows the ambient air freezing system 10 with a cooling chamber 26 connected thereto. Once the system has been initially charged, packing 19 and 21 of regenerator 18 and 20, respectively, have been cooled to the desired −120° C. temperature. Fan 12 then blows ambient air from outside the system through the preliminarily cooled first regenerator 18. The cold air is then pumped via valve 28 into cooling chamber 26 through inlet 32. At the air refrigeration return 34 of chamber 26, the temperature of the air has increased (warmed) to approximately −80° C. as a result of the heat from the object(s) being cooled. The return air is then fed into turbo expander 16 where it is expanded from 1 atmosphere to 0.5 atmosphere (Kgf/cm); doing the mechanical work and reducing the temperature of the air back to −120° C. The −120° C. air is then fed into second regenerator 20 via line 23 and valve 24. The packing 21 of second regenerator 20 is then chilled by the −120° C. air flowing therethrough. After packing 21 is chilled, the air then passes through valve 22 and returns to compressor 14 via line 27 where it is compressed to atmospheric pressure (i.e., 1 atmosphere). The pressure increase in the air raises its temperature to approximately +100° C. at which time it is exhausted from the system through exhaust output 30.

Valves 22 and 24 operate simultaneously and thereby cause first and second regenerators 18 and 20, respectively, to alternately receive the cold air generated by the expander and ambient air from outside. While the packing 19 of first regenerator 18 is being cooled by the expanded air from expander 16, the second regenerator 20 is receiving a flow of air from outside the system having the ambient temperature and vice versa. Thus, once the ambient air has passed through second regenerator 20 and fed into cooling chamber 26, valves 22 and 24 switch position to now feed the outside ambient air to first regenerator 18 and the expanded air from expander 16 to second regenerator 20.

Compressor 14 can be any compressor of suitable known type. Multiple stage compressors have proven to work more efficiently with the system. Expander 16 can be any expander of suitable known type, such as, for example, an adiabatic expander. Motor 11 provides power to compressor 14 and expander 16 via shaft 15. Motor 11 has a shaft speed of 3,000 rpm and operates at 50–60 Hz with an appropriate supply voltage. The cooling chamber 26 can be replaced with any applicable cooling chamber for the products being frozen.

Figure 4:
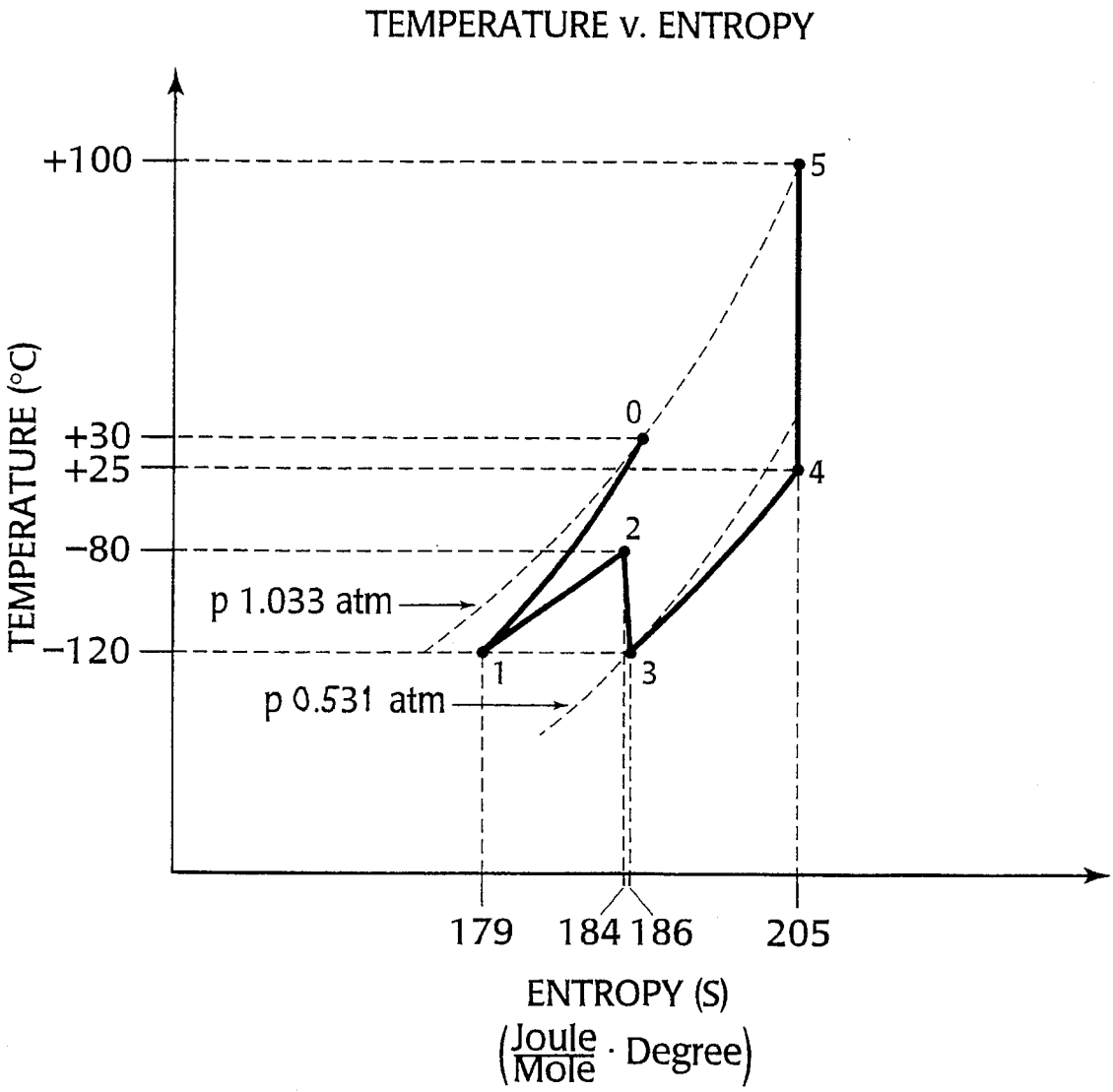
FIG. 4 is a graphical representation of temperature vs. entropy of the air freezing process according to the invention.

FIG. 4 shows a graphical representation of the process of ambient air freezing performed by the ambient air freezing system 10. It is to be understood that the system has been fully charged to its operating equilibrium before starting the process as depicted by FIG. 4. As shown at point 0, ambient air at a temperature of +30° C. is drawn into the system through fan 12. The input of ambient air is then cycled into the first regenerator 18 where the temperature has now been reduced to −120° C. as shown by point 1. The cooled air is then fed into the cooling chamber 26, where the air temperature is warmed to −80° C. by taking heat from the object being cooled, as shown by point 2. The −80° C. air is then fed into turbo expander 16 where the air pressure is expanded to a pressure of 0.5 Kgf/cm2, as shown by point 3. The expansion of the pressure reduces the air temperature back to −120° C. This cooled air is then fed into the second regenerator 20 where it cools its packing. This is shown by the transition of points 3–4. The air which is now at approximately +25° C. is then fed back into compressor 14 where it is compressed to atmospheric pressure, as shown by points 4–5. This compression increases the air temperature to +100° C. and is subsequently discharged into the surrounding atmosphere.

In a preferred embodiment, the refrigeration capacity of freezing system 10 is 26,000 Kcal/hr, while the power consumed by the system is only 85 KW/hr. However, the refrigeration capability and capacity of freezing system 10 is unlimited with the power consumption rating changing relative to the desired freezing capacity.

While one embodiment of the present invention has been shown and described, it is to be understood that many changes and modifications may be made thereunto without departing from the spirit and scope of the invention as defined in the appended claims.

What is claimed is:

1. An ambient air freezing system for connection to a cooling chamber having an input and a return, the ambient air freezing system comprising:

an ambient air inlet and a chilled air output;

first control means connected to the ambient air input for controlling the input flow of air;

second control means connected to the chilled air output for controlling the output flow of air into the input of the cooling chamber;

regenerator means coupled to said first and second control means for cooling the input ambient air;

a compressor having an input connected with said first control means and said regenerator means and an output, said compressor having a central axis shaft;

an expander having an input coupled with the cooling chamber return and an output coupled with said second control means and said regenerator means, said expander being disposed along the same central axis shaft of said compressor; and an electric motor connected with said compressor for providing power to the system.

2. The ambient air freezing system according to claim 1, wherein said regenerator means further comprises a first and a second regenerator.

3. The ambient air freezing system according to claim 1, wherein said ambient air inlet further comprises a fan for blowing the ambient air from the surrounding atmosphere into the system.

4. The ambient air freezing system according to claim 2, wherein said first control means further controls the flow of air from said first and second regenerators to said compressor.

5. The ambient air freezing system according to claim 4, wherein said second control means further controls the flow of air from said expander to said first and second regenerators.

6. The ambient air freezing system according to claim 5, wherein said first and second control means comprise butterfly valves, said butterfly valves operating simultaneously with each other.

7. The ambient air freezing system according to claim 5, wherein said cooling chamber further comprises a valve connecting said chamber input and return with said chilled air output and the expander input, said valve selectively disconnecting said cooling chamber from the system and thereby enabling the system to charge up to full capacity.

8. A process for cooling ambient air to cryogenic temperature levels for introduction into a cooling chamber comprising the steps of:

i. inputting ambient air into a first regenerator;

ii. cycling the input air into an expander;

iii. expanding the air to 0.5 atmosphere;

iv. cycling the expanded air into a second regenerator;

v. removing the expanded air from the second regenerator after the packing therein has been chilled;

vi. compressing the removed expanded air from the first regenerator to 1 atmosphere;

vii. exhausting the recompressed air from the first regenerator out of the system;

viii. inputting ambient air into the second regenerator;

ix. cycling the air cooled by the second regenerator into the expander, so that the cooled air is expanded to 0.5 atmosphere;

x. cycling the expanded air into the first regenerator;

xi. removing the expanded air from the first regenerator after the packing has been chilled;

xii. compressing the removed expanded air from the first regenerator to 1 atmosphere;

xiii. outputting the chilled ambient air into a freezer or other cooling chamber; and wherein the performing of steps viii–xiii begins after step v is complete and simultaneously with steps vi and vii, and the entire process is repeated multiple times to produce chilled air in the cryogenic temperature range.

* * * * *